US006331005B1

(12) United States Patent
Ozanne, II

(10) Patent No.: US 6,331,005 B1
(45) Date of Patent: Dec. 18, 2001

(54) TACTICAL TENNIS

(76) Inventor: Dominic L. Ozanne, II, 27900 S.Woodland Rd., Pepper Pike, OH (US) 44124

( * ) Notice: Subject to any disclaimer, the term of this patent is extended or adjusted under 35 U.S.C. 154(b) by 0 days.

(21) Appl. No.: 09/457,144

(22) Filed: Dec. 9, 1999

(51) Int. Cl.[7] ..... A63F 3/00
(52) U.S. Cl. ..... 273/244; 273/236; 273/247
(58) Field of Search ..... 273/244, 236, 273/247

(56) References Cited

U.S. PATENT DOCUMENTS

D. 215,740 * 10/1969 Delfausse ..... D21/1
3,933,355 * 1/1976 Pearce ..... 273/85 R
3,949,992 * 4/1976 Battis ..... 273/85 R
4,007,937 * 2/1977 Casciano et al. ..... 273/134 CA
5,248,147 * 9/1993 Smith ..... 237/244

FOREIGN PATENT DOCUMENTS 2 194 453-A * 3/1988 (GB) .

* cited by examiner

*Primary Examiner*—Jeanette Chapman
*Assistant Examiner*—Dolores R. Collins
(74) *Attorney, Agent, or Firm*—Woodling, Krost & Rust

(57) ABSTRACT

An apparatus for playing a tennis game having a rectangular grid containing axes of abscissas and ordinates. Dice are used to determine if a player may serve into and/or into and through the appropriate advantage or deuce courts. Dice are also used to determine if a player may move to and return the serve. Initial service and defensive positions are chosen by the players prior to the beginning of the service. A process for teaching the game is also disclosed so as to enable the players to learn the game as applied to the axes of abscissas and ordinates.

3 Claims, 4 Drawing Sheets

TACTICAL TENNIS

FIELD OF THE INVENTION

This invention is a tennis game. The game teaches the strategic play of the game of tennis. The game introduces the players to the concepts of probability and statistics and provides an opportunity for visual learning. Tennis is basically a game of geometry and the principles disclosed herein will teach the players about probability, chance and statistics as well as math. Specifically, the disclosure will enable an understanding of the x, y Cartesian coordinate system along with statistics.

BACKGROUND OF THE INVENTION

The invention was conceived as a way of relating the Cartesian coordinate system to a person by visualizing the Cartesian coordinate system in relationship to a tennis court. Essentially the Cartesian coordinate system has four quadrants. The first quadrant is that portion of the coordinate system where values of x and y are both positive. The second quadrant of the Cartesian coordinate system is that area where the values x are negative and the values of y are positive. The third quadrant of the Cartesian coordinate system is where the values of x are negative and the values of y are negative and the fourth quadrant of the Cartesian coordinate system are where the values of x are positive and y is negative.

Probability is introduced into the instant invention by way of a number generator. Preferably the number generator is a pair of dice. Alternately the number generator may be a simple spinning wheel with numbers on it and the spinner or pointer will determine the number that is used. Obviously, the spinning wheel has no bias as the dice do. This will further help individuals understand the difference in probabilities.

U.S. Pat. No. 4,215,861 to Nemeth discloses an electronic tennis game which includes a microcomputer system which and when actuated by switches accepts inputs from those switches and processes those inputs according to a simulated tennis game to provide outputs in the form of the illuminated rectangular grids on the game board to indicate respective player and ball positions and to update the scoring displays. The '861 patent permits the players to select the longitudinal and latitudinal positions of the ball by means of a grid system labeled 1–16 across the top or x axis and 1–35 along the y axis. The selection of the positions in connection with the '861 patent are determined by a keyboard 60 as indicated in FIG. 1.

U.S. Pat. 3,949,992 to Battis discloses a tennis simulating table game which includes player-representing tokens that have different playing strengths and weaknesses designated on them. Transparencies overlie certain board sections and dice are used to develop numbers and there is a chart giving ranges of numbers that represent failure or success of the players in making the shots. The receiving player returns the ball in certain sections near him, fails if it is in other sections, and rolls the dice if it falls in still other sections. A player's chance of return depends on the dice values he rolls as related to the strength or weakness shown in his token. The '992 patent uses a combination of probability and a series of cards which indicate whether or not a shot is good or not good according to the player's rating.

SUMMARY OF THE INVENTION

The object of tactical tennis is the same as regular tennis. Each player attempts to place the ball over the net and within the boundary lines so that the ball cannot be returned by the opponent. The server starts at the baseline in the advantage or deuce court. The receiver may stand anywhere, however, if the server is able to pass the returner on the serve, the serve is considered an ace.

The server rolls the dice and may move (not diagonally) one space per number based on the sum of the dice. The returner rolls the dice and moves to the ball and returns it, making one move per number based on the sum of the dice. The players take turns rolling the dice and moving until one person is not able to move the ball enough times to get it over the net. Scoring proceeds according to standard tennis rules.

A roll of five on the serve is a let serve. A player may move the ball and himself/herself during a turn. For example if a player rolls a seven, they may move the ball five spaces and they may move himself/herself two spaces (not diagonally).

The game is based upon simple plane geometry, and can be graphed in the x-y plane. In fact, the idea for the game developed from studying basic algebra. The rules of the game may be expanded to require the player to state the coordinates of the shot or graph the line and determine the slope of each shot. Coordinates can be plugged into a graphing calculator by each player. The players need not really know or understand the nature of tennis. An understanding of tennis is helpful but not necessary to play the game. This game tests the actual tactical abilities of a player where success is determined by placing the ball out of the other player's reach based upon an understanding of the tennis court. This is why the game is called tactical tennis.

The apparatus for playing the tennis game comprises a pair of dice with each die being in the shape of a cube and having indicia thereon representing numerals 1, 2, 3, 4, 5 and 6. Therefore the possibilities of the additive sum of the numerals is in the range of 2–12. The apparatus also includes a game board having indicia thereon. The indicia on the game board represents a tennis court and coordinates with respect to the tennis court. These coordinates are commonly known as Cartesian coordinates. The coordinates lie along the x and y axes. The X—X axis is known as the axis of abscissas and the Y—Y axis is known as the axis of ordinates. The apparatus for playing the game further includes a first playing piece for movement by a first player, a second playing piece for movement by a second player, and a third playing piece representing the tennis ball.

A process for teaching the game of tennis is also disclosed which employs a game board having indicia thereon, said indicia representing a tennis court including advantage courts, deuce courts, back courts, fore courts, a net, sidelines, baselines, axes of ordinates, and axes of abscissas, a pair of dice with each die having indicia thereon representing numerals 1, 2, 3, 4, 5 and 6, a first playing piece for marking the position of a first player, a second playing piece for marking the position of a second player, and a third playing piece for marking the position of the tennis ball. The game includes the steps of each player rolling the dice to see which player goes first as far as service is concerned. The person that rolls the dice and has the highest number serves first. The object of the tennis game is to score at least two more points than the opponent. Scoring in tennis 0 or love, 15, 30, 40, deuce, advantage, game.

Each player picks a position on the game board from which serves and defenses are made, respectively. The player serving rolls the dice to obtain a sum of the dice. If the sum of the dice is sufficiently large to serve the piece representing the tennis ball from the position of the first player to a position beyond the net and/or into and through the deuce court of the second player, the serve is good. If the server serves past the returner, it is considered an ace and a point is scored for the server. If the sum of the dice is not sufficiently large to serve the piece or ball beyond the net and/or into and through the appropriate deuce court of the second player, then the first player must roll the dice again to obtain a new sum of the dice. The serving player must serve the third piece (or ball) according to the axes of ordinates or abscissas on the tennis court. As simply put, this means the tennis ball may not move diagonally from coordinate to coordinate but must instead move in a straight line fashion on or parallel to the x and/or y axes.

If neither of the rolls of the server are sufficiently large to advance the piece representing the ball beyond the net and/or into and through the deuce court of the second player, the player loses a point to the second player.

Once a successful serve is made, the other player rolls the dice. A determination is made if the sum of the dice is sufficiently large to enable the other player to move to and return the ball (piece) beyond the net and into and through the court of the server. Moving the ball into and/or into and through the court of the server is possible if the sum of the dice is sufficiently large to return the ball. A point will be scored for the server if the sum of the dice rolled by the other player is not sufficiently large to return the ball into and/or into and through the court of the server. If the ball is successfully returned by the other player, the server again roll the dice again to determine whether he is able to reach and/or return the ball for further play.

It is an object of the present invention to disclose a game which will aid the student of the game in playing the game of tennis while comprehending mathematics and statistics.

It is a further object of the present invention to provide fun and enjoyment to the players of the game.

It is a further object of the present invention to provide a game which will familiarize the players of the game with the x-y coordinate system. The players will learn the game of tennis while also learning the x-y Cartesian coordinate system. Students will understand the probability, namely, they will understand what the chances are of reaching a certain spot on the game board and being able to return the ball after having received it from the server.

It is a further object of the present invention to teach the student who is the server what statistics or probability means while serving a tennis ball. In particular, a student will realize that he must have at least a sum of five on the dice in order to serve the ball over the net.

Further objects of the present invention will be understood when taken in combination with the brief description of drawings, the description of the invention and the claims which follow hereinbelow.

DESCRIPTION OF THE INVENTION

Figure 1:
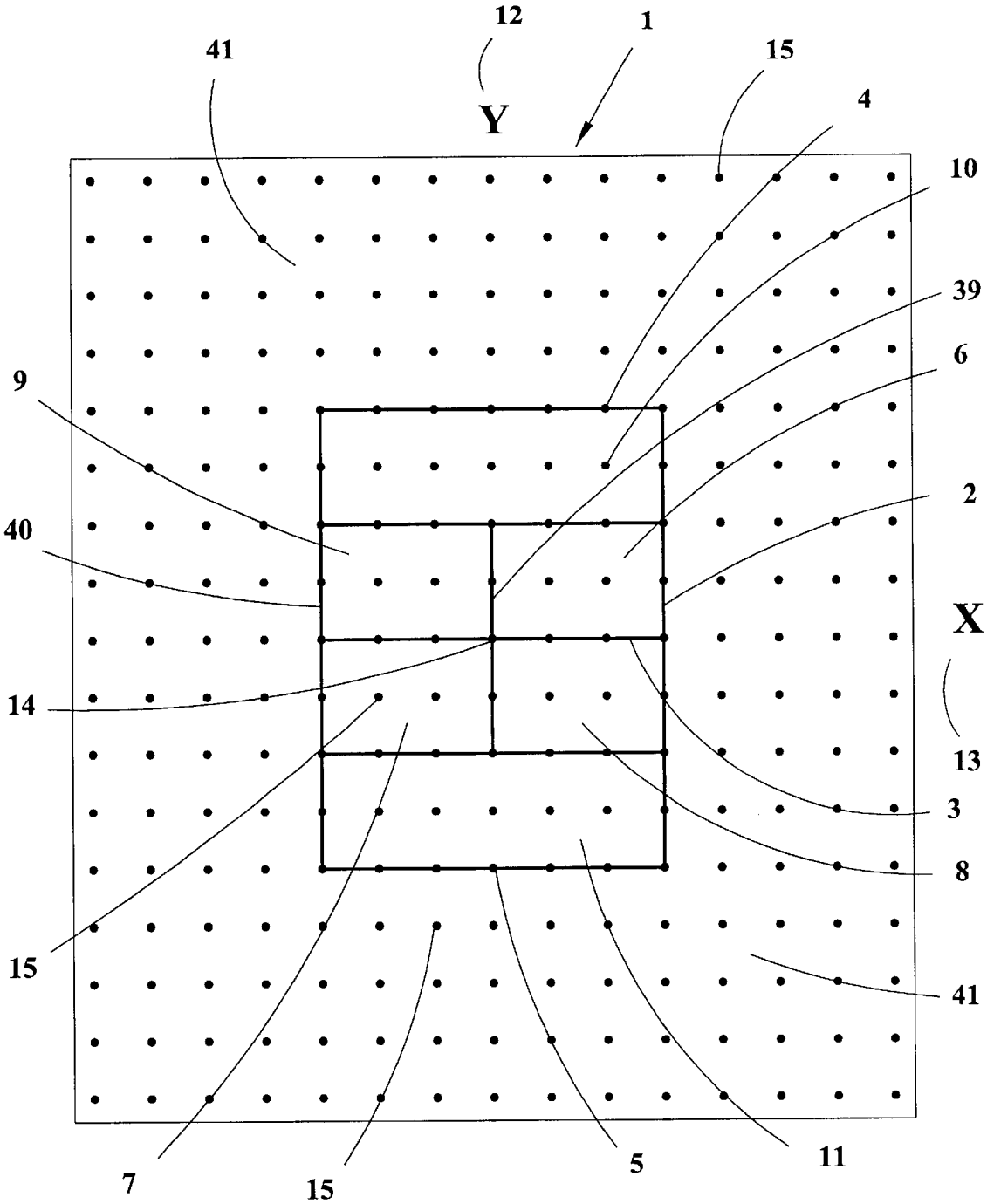
FIG. 1 is a plan view of the game board indicating the tennis court, net, advantage courts, deuce courts, fore courts, sidelines and baselines together with the axes of abscissas and axes of ordinates.

FIG. 1 is plan view of the game board indicating the tennis court, net, advantage courts, deuce courts, deuce courts, fore courts, sidelines and baselines together with the axes of abscissas and the axes of ordinates. The axes of ordinates is the y axis and the axes of abscissas is the x axis. The x axis is denoted by reference numeral 13 and y axis is denoted by reference numeral 12. Reference numeral 14 indicates the origin. Reference numeral 39 indicates the line separating the advantage and deuce courts. The tennis court board is indicated by reference numeral 1 and the actual tennis court is defined by the baselines 4, 5 and sidelines 2 and 40. Reference numeral 41 indicates an area between the tennis court and an area which would be defined as being off the game board 1.

The net is represented by reference numeral 3. The advantage courts are represented by numerals 6 and 7, and the deuce courts are represented by reference numerals 8 and 9. The back courts are represented by reference numerals 10 and 11, and the coordinates are represented globally by reference numeral 15.

Figure 2:
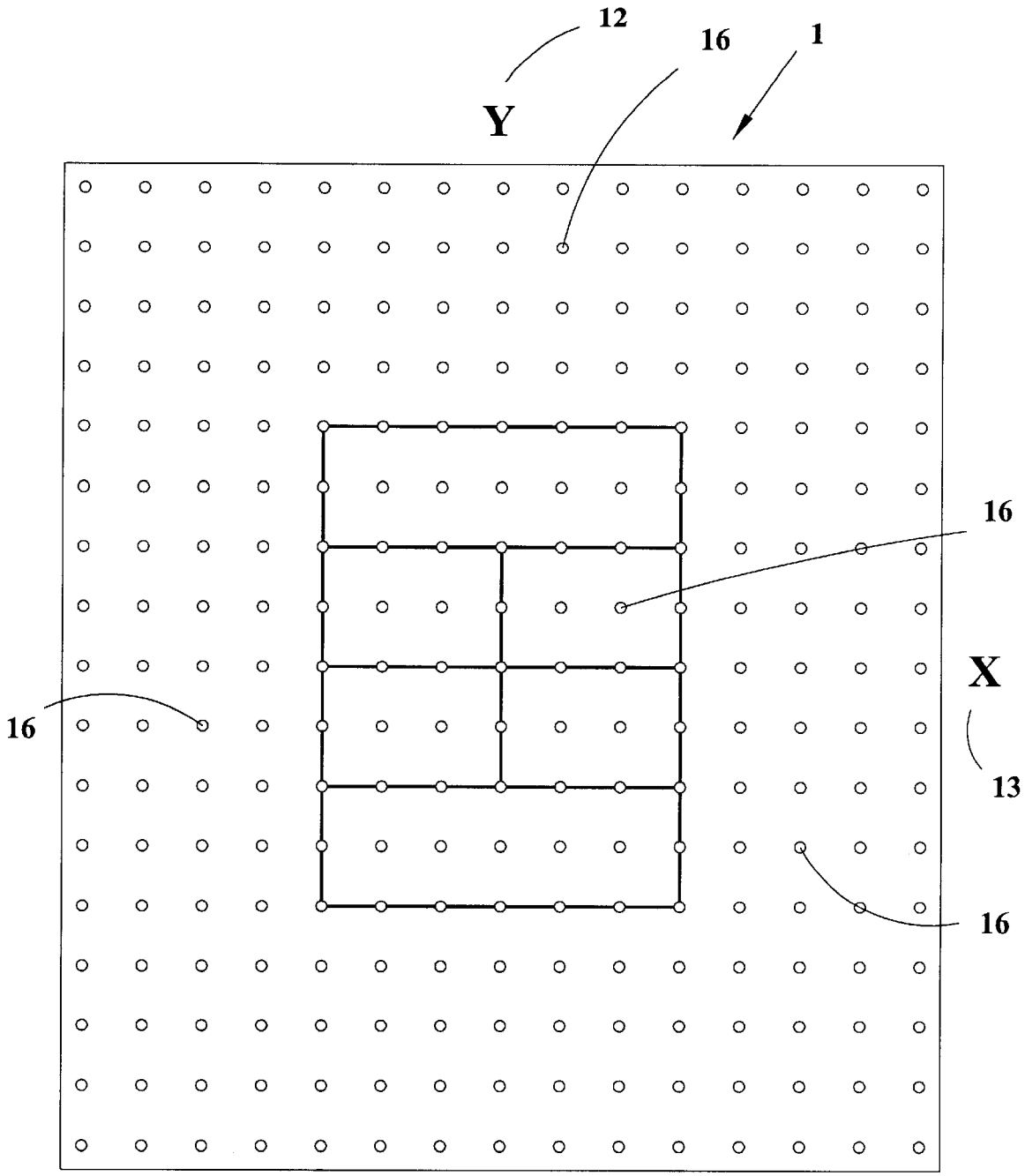
FIG. 2 is a plan view of the game board similar to the view in FIG. 1 except the coordinates are illustrated as bores in the game board.
Figure 4:
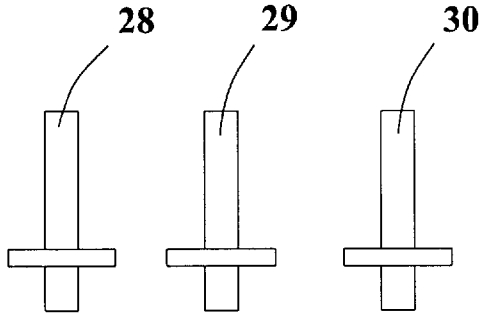
FIG. 4 is an elevational view of a first, second and third peg representing two players and the ball.

FIG. 2 is plan view of the game board similar to the view in FIG. 1 except the coordinates 16 are illustrated as boards in the game board. FIG. 4 is an illustration of a first peg 28, a second peg 29, and third peg 30 which interfit with the bores 16 of the game board 1 as shown in FIG. 2. The pegs are generally cylindrically shaped and have a flanged portion thereon which limits their insertion in to the bore 16.

Figure 3:
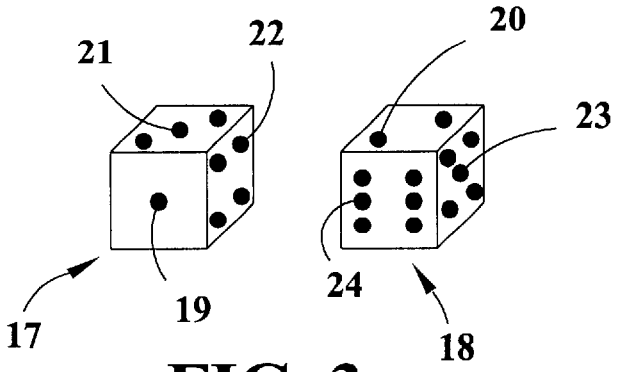
FIG. 3 is an elevational view of a pair of dice with indicia 1 through 6 thereon.

FIG. 3 is an elevational view of a pair of dice with indicia 1–6 indicated thereon. The die 17 includes reference numeral 19 signifying an indicia 1, reference numeral 20 signifying an indicia 3, and reference numeral 22 signifying an indicia of 4. Die 18 includes indicia thereon with reference numeral 24 representing an indicia of 6, reference numeral 23 representing an indicia of 5, and reference numeral 20 representing an indicia of 2.

Figure 5:
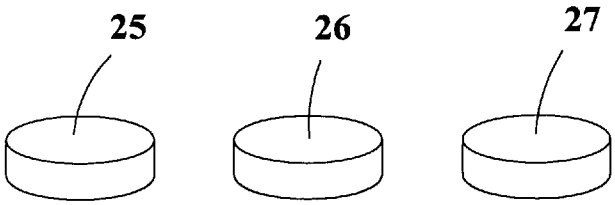
FIG. 5 is an elevational view of a first, second and third disk representing two players and the ball.

FIG. 5 is an elevational view of a first playing piece 25; a second playing piece 26, and a third playing piece 27. The pieces 25, 26 and 27 are disk shaped pieces. The pegs or pieces represent and track the position and movement of the players and also the ball. For instance, pegs 28 and 29 could each represent the first and second players and peg 30 may represent the ball. Similarly disks 25 and 26 may represent the players and disk 27 may represent the ball.

Figure 6:
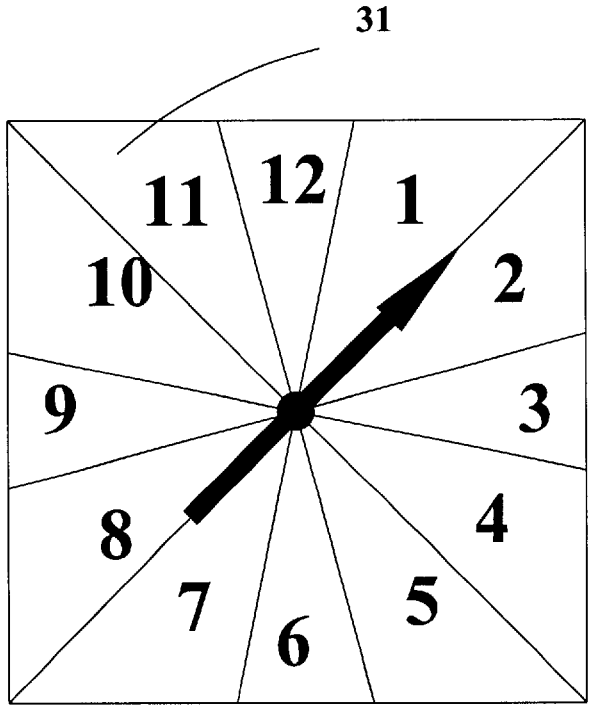
FIG. 6 is a plan view of an alternate spinning wheel which generates numbers in lieu of the dice illustrated in FIG. 3.

FIG. 6 is a plan view of an alternate number generator, namely, a spinning wheel. Those skilled in the art will readily recognize that each number 1–12 is equally probable because the spinner has no bias. Reference numeral 31 represents the alternate number generator.

Those skilled in the art will readily recognize the probability associated with the dice. Namely, the probability of getting a sum of 7 is the largest probability and the probability of getting a 6 or an 8 is the next largest probability, followed by the probability of getting a 5 or a 9, followed by the probability of getting a 4 or a 10, followed by the probability of getting a 3 or an 11, followed lastly by the probability of getting a 2 or a 12.

Figure 7:
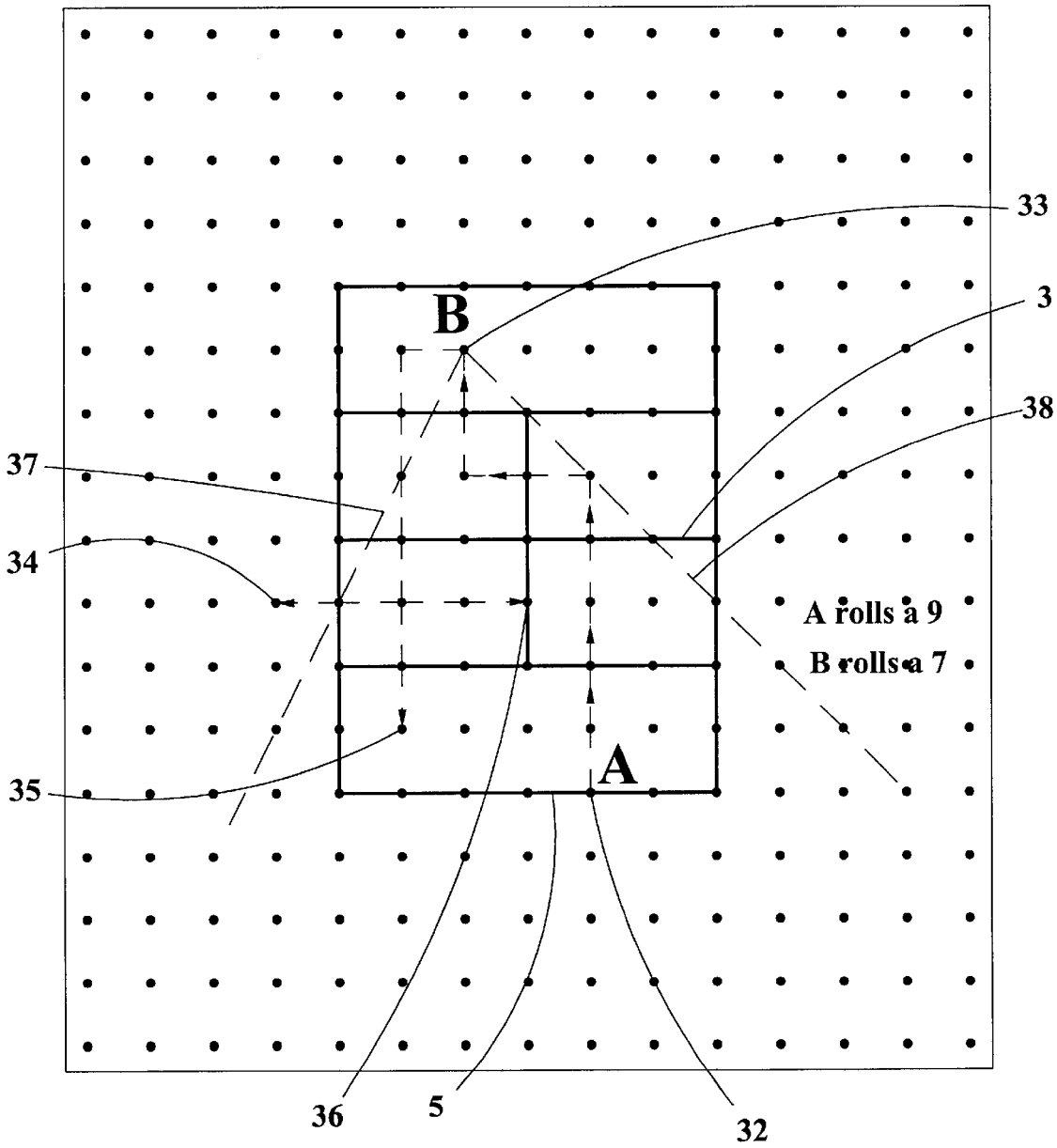
FIG. 7 is a schematic representation of a method of playing the game illustrating possible returns of the defending player and a zone of acceptable possible returns.

FIG. 7 is a schematic representation of a method of playing the game illustrating possible returns of the defending player and a zone of acceptable, possible returns. Reference numeral 32 represents the initial position of the first player A. Reference numeral 33 indicates the initial position of the second player B. If player A rolls a 9 in his combination of the individual readings of the dice, he may choose to serve the ball directly to player B. In all probability, however, he will not serve the ball directly to player B but instead will try to serve it such as to cause player B to move from his or her initial position as indicated by reference numeral 33. It is then B's turn and s/he will attempt to return the serve which was directly hit to him. B then rolls a 7. Now B can return the ball as indicated by three different possible paths.

The first possible choice of B as represented by reference numeral 34 is no good as it does not cross the net 3. B's second possible choice as represented by reference numeral 35 is good. This would cause player A (sometimes referred to herein as the first player A) to have to move a large distance to get to the ball as indicated by reference numeral 35. Specifically, player A, the first player, will consume four moves to reach the ball as indicated by reference numeral 35. In addition, A would have to roll at least an 8 to be able to move to the ball and to get the ball over the net 3. This is because position 35 is three positions away from the net and he has to roll at least 3 to get to the net and then an additional 1 to get over the net.

B's third possible choice would be as represented by reference numeral 36. In this instance A would have a long distance (4 spaces) to move to get to the ball and return it over the net. However, if B chose to return the ball to the point represented by reference numeral 36, that would require A to move 4 spaces but A would then would be only one space away from the net. Therefore, one can see that this would not be the most advisable move for B because it sets A up for an easy return over the net. B, as is taught herein, may move to other positions that are not shown by one of these three possible choices. In fact, the possible choices for a move by B are bounded by the lines 37 and 38 which define possible good shots on B's return.

A process for teaching the game is disclosed herein. The players at the beginning of the game first each roll the dice (17,18) to obtain a number which is the sum of each die. The player with the highest number will serve first. The players then pick positions on the game board from which one player will serve and the other player will defend. The first player or the serving player rolls the dice to obtain the sum of the dice. If the sum of the dice is sufficiently large to serve, the ball (third piece 27 or 30) from the position selected by the first player beyond the net 3 and into and/or into and through the deuce court of the second player, the serve will be good. If the serve passes the player, he will be awarded an "ace" and a point. The first and second players will be designated by either pegs 28 and 29 or disks 25 and 26. The pegs 28 and 29 will be inserted in one of multiple bores 16 of FIG. 2 or the disks 25 and 26 will reside on the game board itself.

If the sum of the serving player, the first player's dice, is not sufficiently large to serve the ball (third piece 30) beyond the net 3 and into and/or into and through the deuce court of the second player, then the first player must roll the dice again to obtain a new sum of the dice.

If the additive sum of the dice is sufficiently large, then the first player may serve the ball (third piece) according to movements along the x and y axes and/or parallel to the x and y axes of the tennis court. If the additive sum of the dice is not sufficiently large to serve for a second time, then the first player loses a point.

Once a good serve is made by one player, the other player rolls the dice to determine if the sum of the dice is sufficiently large to move to and return the ball (third piece) beyond the net and into and/or into and through the court of the player who has successfully served the ball. If the sum of the dice of the returning is sufficiently large to return then ball, the returning player moves to the third piece and moves said third piece into and/or into and through the court of the server. If pieces 25 or 26 are used to mark the positions of the players those pieces are moved to the spot where the ball 27 is "hit." The ball 27 is then moved to the spot as directed by the player hitting the ball.

If the returning player's sum of the dice is not sufficiently large to return the third piece in to and/or into and through the court of the serving player, a point is scored by the server.

The server must then repeat the procedure. Namely, he rolls the dice or spins the spinner to determine if he has a large enough number to move to the ball (marking that spot with a piece 25 or a peg 28) and to then advance that ball over the net. If the server cannot do this a point is scored for the defender.

It will be understood by those skilled in the art that certain modifications and design changes may be made to the foregoing invention without departing from the spirit and scope of the appended claims which follow.

I claim:

1. A process for teaching the game of tennis employing a game board having indicia thereon, said indicia representing a tennis court including advantage courts, deuce courts, back courts, fore courts, a net, sidelines, baselines, axes of ordinates and axes of abscissas, a pair of dice with each die having indicia thereon representing numerals 1, 2, 3, 4, 5 and 6, a first playing piece for marking the position of a first player, a second playing piece for marking the position of a second player, and a third playing piece for marking the position of the tennis ball, comprising the steps of:

rolling the dice by said first player to obtain a number which is the sum of each die;

rolling the dice by said second player to obtain a number which is the sum of each die;

comparing the numbers obtained by each player rolling the dice so as to determine which player has the largest number thereby defining the server;

choosing positions on said game board by each of said players from which serves and defenses will be made;

placing markers on the respective positions chosen by said server and said defender:

rolling said dice by said first player (server) to obtain a sum of said dice;

determining if said sum of said dice is sufficiently large to serve said third piece from the position of said server beyond said net and into and/or into and through the deuce court of said defender, and, if said sum of said dice is not sufficiently large to serve said third piece beyond said net and into and/or into and through the deuce court of said defender, then said server rolls said dice again to obtain a new sum of said dice;

advancing, moving and marking said third piece according to said axes of ordinates and abscissas on said tennis court by said server according to the sum of said dice if one of said sums is sufficiently large;

losing a point to said defender if neither of said rolls of said dice are sufficiently large to advance said third piece of said first player beyond said net into and/or into and through the deuce court of said defender;

repeating said previous steps until said server is able to serve into and/or into and through the deuce court of said defender;

rolling the dice by said defender to determine if s/he will be able to return the serve;

determining if said sum of said dice is sufficiently large to move to and return said third piece beyond said net and into and into and/or through said court of said server;

moving to said third piece and placing said defender's marker on said game board accordingly and moving and placing said third piece into and/or into and through said court of said server if said sum of said dice is sufficiently large to return said third piece;

scoring a point for said server if said sum of said dice rolled by said second player is not sufficiently large to move to or return said third piece into and/or into and through said court of said server;

rolling the dice by said server if said third piece was returned to and/or to and through said court of said server said defender; and, repeating said previous steps to determine the movement of said third piece and scoring for said players.

2. A process for teaching the game of tennis as claimed in claim 1 further comprising the steps of:

increasing by one the number required to advance said third piece beyond said net to accommodate for the height of said net.

3. A process for teaching the game of tennis as claimed in claim 1 further comprising the step of:

including an algebraic relationship in the determination of whether or not a sufficiently large number has been obtained to advance said third piece into and through the appropriate advantage or deuce courts on the serve and/or to return the serve.

* * * * *

UNITED STATES PATENT AND TRADEMARK OFFICE

CERTIFICATE OF CORRECTION

PATENT NO. : 6,331,005 B1
DATED : December 18, 2001
INVENTOR(S) : Dominic L. Ozanne It is certified that error appears in the above-identified patent and that said Letters Patent is hereby corrected as shown below:

Column 4,
Line 4, delete ";" and insert -- . --
Line 12, delete the second occurrence of "deuce courts,"
Line 32, delete "boards" and insert -- bores --
Line 46, delete ";" and insert -- , --

Column 5,
Line 34, delete "would" which occurs between "then and be"

Column 6,
Line 9, insert -- player -- between "returning and is"
Line 51, delete ":" and insert -- ; --
Lines 57 and 60, insert -- along said axes of ordinates and abscissas -- after "defender" and before ","
Line 63, insert -- along -- after "piece"
Line 64, delete "according to" before "said"
Line 65, insert -- in a path chosen -- after "court" and before "by"

Column 7,
Lines 4 and 7, insert -- along said axes of ordinates and abscissas -- after "defender" and before ";"
Lines 13 and 22, insert -- along said axes of ordinates and abscissas -- after "server" and before ";"
Line 17, insert -- along said axes of ordinates and abscissas -- after "server" and before "if"
Line 20, delete "second player" and insert -- defender --
Line 22, insert -- along said axes of ordinates and abscissas -- after "server" and before ";"

UNITED STATES PATENT AND TRADEMARK OFFICE

CERTIFICATE OF CORRECTION

PATENT NO. : 6,331,005 B1
DATED : December 18, 2001
INVENTOR(S) : Dominic L. Ozanne It is certified that error appears in the above-identified patent and that said Letters Patent is hereby corrected as shown below:

Column 8,
Line 3, insert -- by -- after "server" and before "said"
Line 3, insert -- along said axes of ordinates and abscissas -- after "defender" and before ";"

Signed and Sealed this

Thirtieth Day of April, 2002

*Attest:*

*Attesting Officer*

JAMES E. ROGAN
*Director of the United States Patent and Trademark Office*